US012104457B2

(12) United States Patent
Scott

(10) Patent No.: US 12,104,457 B2
(45) Date of Patent: Oct. 1, 2024

(54) FAILSAFE SAFETY VALVE WITH LINEAR ELECTROMECHANICAL ACTUATION

(71) Applicant: Halliburton Energy Services, Inc., Houston, TX (US)

(72) Inventor: Bruce Edward Scott, McKinney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 21 days.

(21) Appl. No.: 17/964,789

(22) Filed: Oct. 12, 2022

(65) Prior Publication Data

US 2023/0349262 A1 Nov. 2, 2023

Related U.S. Application Data

(60) Provisional application No. 63/336,673, filed on Apr. 29, 2022.

(51) Int. Cl.
*E21B 34/06* (2006.01)

(52) U.S. Cl.
CPC ..... *E21B 34/066* (2013.01); *E21B 2200/03* (2020.05); *E21B 2200/04* (2020.05); *E21B 2200/05* (2020.05); *E21B 2200/06* (2020.05)

(58) Field of Classification Search
CPC ..... E21B 21/103; E21B 33/00; E21B 34/066; E21B 2200/03; E21B 2200/04; E21B 2200/05
See application file for complete search history.

(56) References Cited

U.S. PATENT DOCUMENTS

| | | | |
|---|---|---|---|
| 8,727,008 | B2 | 5/2014 | Krpec |
| 8,800,668 | B2 | 8/2014 | Bouldin et al. |
| 9,903,180 | B2 | 2/2018 | Boutin et al. |

(Continued)

FOREIGN PATENT DOCUMENTS

| | | |
|---|---|---|
| EP | 1236862 A1 | 9/2002 |
| WO | 2011094084 | 8/2011 |

(Continued)

OTHER PUBLICATIONS

Netherlands Office Action for NL Patent Application No. 2033945 dated Aug. 2, 2023.

(Continued)

*Primary Examiner* — Christopher J Sebesta
*Assistant Examiner* — Lamia Quaim
(74) *Attorney, Agent, or Firm* — Scott Richardson; C. Tumey Law Group PLLC

(57) ABSTRACT

A linear electromechanical actuator with a failsafe design may be used with a downhole flow control system. In one example, a subsurface safety valve for controlling flow of production fluids includes a valve closure element moveable between an open position and a closed position in response to a linear movement of an actuating member. A biasing member biases the valve closure element to the closed position. A power section with an electrically-powered motor drives a rotation. A drive section coupled to the power section converts the rotation of the motor to the linear movement of the actuating member to at least open the subsurface safety valve. A clutch selectively decouples the power section from the drive section in response to a power loss.

16 Claims, 8 Drawing Sheets

(56) References Cited

U.S. PATENT DOCUMENTS

| | | | | |
|---|---|---|---|---|
| 2004/0173362 | A1* | 9/2004 | Waithman | E21B 34/066 166/386 |
| 2011/0186303 | A1* | 8/2011 | Scott | E21B 34/08 166/373 |
| 2013/0199791 | A1 | 8/2013 | Hill, Jr. et al. | |
| 2013/0248203 | A1 | 9/2013 | Scott et al. | |
| 2014/0158345 | A1* | 6/2014 | Jang | E21B 43/261 166/305.1 |
| 2016/0359388 | A1* | 12/2016 | Strattan | F04D 15/0281 |
| 2018/0347313 | A1 | 12/2018 | Joseph et al. | |
| 2020/0032616 | A1* | 1/2020 | Vick, Jr. | E21B 34/14 |

FOREIGN PATENT DOCUMENTS

| | | |
|---|---|---|
| WO | 2021048225 | 3/2021 |
| WO | 2021173684 | 9/2021 |

OTHER PUBLICATIONS

International Search Report and Written Opinion for International Patent Application No. PCT/US2022/048799 dated Mar. 7, 2023.

* cited by examiner

FAILSAFE SAFETY VALVE WITH LINEAR ELECTROMECHANICAL ACTUATION

CROSS-REFERENCE TO RELATED APPLICATIONS

The present application is a non-provisional conversion of U.S. Patent Application No. 63/336,673, filed on Apr. 29, 2022, the entire disclosure of which is incorporated herein by reference.

BACKGROUND

Wells are commonly drilled for recovery of hydrocarbons such as oil and gas. A myriad of tools are used downhole (i.e., downhole tools) for constructing, completing, operating, and servicing a well. Tools are often tripped downhole on a suitable conveyance in a run-in configuration, to minimize obstructions to movement and prevent tool damage. Examples of downhole tools include wellbore sealing devices used to isolate zonal intervals and valves used to control the flow of production fluids. Such tools are predominantly hydraulically-actuated.

A subsurface safety valve (alternately referred to as an "SSSV") is commonly installed as part of the production tubing within oil and gas wells to protect against unwanted communication of high pressure and high temperature formation fluids to the surface. These subsurface safety valves are designed to shut in fluid production from the formation in response to a variety of abnormal and potentially dangerous conditions. When built into the production tubing, SSSVs may be referred to more specifically as tubing retrievable safety valves ("TRSV") since they can be retrieved by retracting the production tubing back to surface.

SSSVs are normally operated by hydraulic fluid pressure, which is typically controlled at the surface and transmitted to the SSSV via hydraulic control lines. Hydraulic fluid pressure must be applied to the SSSV to place the SSSV in the open position. When hydraulic fluid pressure is lost, the SSSV will transition to the closed position to prevent formation fluids from traveling uphole through the SSSV and reaching the surface. As such, SSSVs are commonly characterized as fail-safe valves, as their default position is closed.

BRIEF DESCRIPTION OF THE DRAWINGS

These drawings illustrate certain aspects of some of the embodiments of the present disclosure and should not be used to limit or define the method.

DETAILED DESCRIPTION

The disclosure presents a linear electromechanical actuator with fail-safe features as an alternative to a hydraulic system for actuating a downhole tool. The downhole tool in the examples discussed comprises a downhole valve, such as a subsurface safety valve (SSSV), which is optionally a tubing retrievable safety valve (TRSV). The disclosed SSSV is able to closed without being hindered by the actuator. The electrification of the SSSV offers many benefits to operators of petroleum wells as compared with existing hydraulic system, such as reduced capital expenditure (CAPEX) and operating expenditure (OPEX), reduced risk of environmental pollution, less chemical risk to people who have to work with the SSSV or with the supporting or operating equipment.

Numerous, non-limiting example embodiments are disclosed with various combinations of modules and other features. One aspect common to the example configurations is a clutch for coupling and selectively decoupling the power section of the actuator (e.g., motor module) from the drive section of the actuator (e.g., screw assembly). The clutch is normally open. When power is removed from the clutch, the clutch disengages, allowing the SSSV to close. Various optional features that may support and enhance this safe operation include a screw assembly, a damper module, a gearing module comprising one or more gears, i.e., gear set, a motor module, a motor sensor module, a brake module, a clutch module, and any combination thereof.

Disclosed configurations may include one or more electrically powered devices, including but not limited to an electromechanical (EM) clutch, EM brake, motor sensor, and motor. All of these electrically powered devices may have at least one coil, one winding, one circuitry, etc., as the case may be. To improve reliability, the devices can include multiple (i.e., 2 or more) coils, multiple sets of circuitry, and/or multiple sets of windings, as the case may be. By having multiples instances of these electrical features, redundancy can be built into the specific device, thereby increasing reliability and/or service life of the linear electromechanical actuator.

Figure 1:
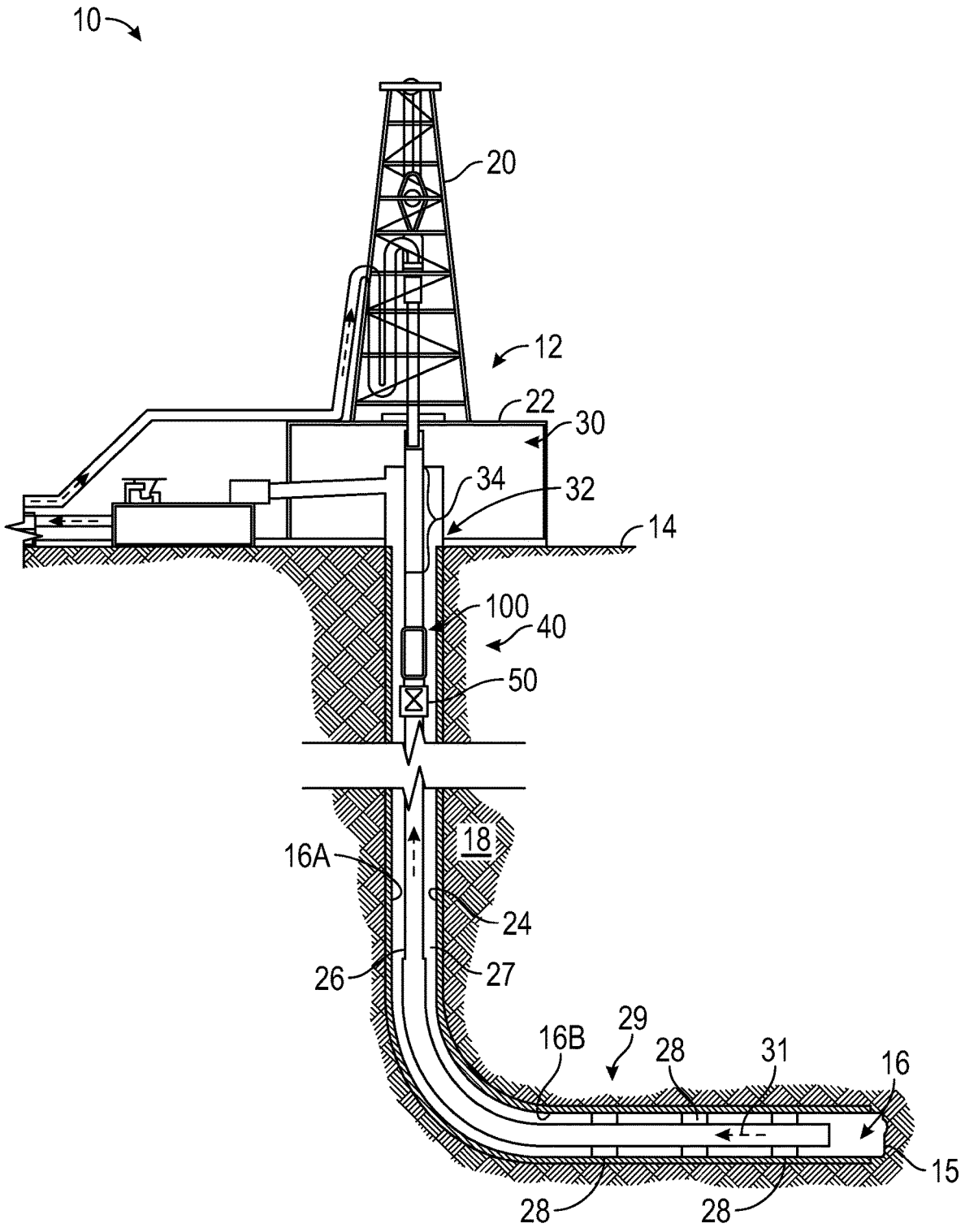
FIG. 1 is an elevation view of a well site in which a linear electromechanical actuator may be deployed according to aspects of this disclosure.

FIG. 1 is an elevation view of a well site in which a linear electromechanical actuator may be deployed according to aspects of this disclosure. While FIG. 1 generally depicts the well site 10 as being for land-based hydrocarbon production, the principles described herein are equally applicable to offshore or subsea production operations that employ floating or sea-based platforms and rigs, without departing from the scope of the disclosure. The well site 10 may include an oil and gas rig 12 arranged at the earth's surface 14 and a wellbore 16 extending therefrom and penetrating a subterranean earth formation 18. The wellbore 16 may be completed and ready for production or already producing in this example. A large support structure such as a derrick 20 is erected at the well site 10 on a support foundation or platform, such as a rig floor 22. In a subsea context, the earth's surface 14 may alternatively represent the floor of a seabed, and the rig floor 22 may be on the offshore platform or floating rig over the water above the seabed. The derrick 20 may be used to support equipment in constructing, completing, producing from, or servicing the wellbore 16. The derrick 20 may be used, for example, to support and manipulate the axial position of a tubing string, a wireline, or other conveyance within the wellbore 16. Such a conveyance may serve various functions, such as to lower and retrieve tools such as subsurface safety valves, to convey fluids from or to the surface 14, and/or to support the communication of signals and power during wellbore operations.

The wellbore 16 may follow any given wellbore path extending from the surface 14 to a toe 15 of the wellbore 16. The wellbore 16 in this example includes a vertical section 16A extending from the surface 14, followed by a horizontal section 16B passing through a production zone 29, and terminating at a toe 15 of the wellbore 16. Portions of the wellbore 16 may be reinforced with tubular metal casing 24 cemented within the wellbore 16. Production tubing 26 is installed inside the wellbore 16, which serves as a fluid conduit for production fluid 31 such as crude oil or gas extracted from the subterranean formation 18 to the surface 14 via the wellhead 32. The production tubing 26 may be interior to the casing 24 such that an annulus 27 is formed between the production tubing and the casing 24. Packers 28 are positioned in the annulus 27 to seal the production tubing 26 to the casing 24 such that production fluid 31 is directed uphole through the production tubing 26. A production tree 30 may be positioned proximate a wellhead 32 to control the flow of the production fluid 31 out of the wellbore 16.

A subsurface flow control system 40 is schematically shown as deployed or in the process of being deployed in the wellbore 16 above the production zone 29 and below the production tree 30. The subsurface flow control system 40 includes a primary SSSV 50 interconnected with the production tubing 26 and a linear electromechanical actuator 100 for selectively actuating the SSSV 50. Although the linear electromechanical actuator 100 and features of the SSSV 50 are discussed separately in certain examples, the linear electromechanical actuator 100 may be an integral subassembly of the SSSV 50 in at least some implementations. The SSSV 50 may be built into the tubing string as a tubing retrievable safety valve (TRSV) or may be inserted into a receptacle in the tubing string, e.g., a wireline retrievable SSSV (WLRSV) also commonly known as an insert SSSV. The SSSV may shut off flow of the production fluid 31 in response to a shut-in event. A shut-in event may be any emergency or other event that can merit shutting-in the well using the subsurface flow control system 40 to stop the flow of production fluid 31. A shut-in event may be associated with, for example, a well failure. Shutting-in the well in response to a shut-in event may help prevent uncontrolled flowing production fluid, which could otherwise cause explosions, damage to surface facilities, injuries to personnel, and/or environmental damage.

A legacy control line 34 is illustrated in FIG. 1 for reference. The legacy control line 34 could be run, for example, from the wellhead 32 along the annulus 17 between the wellbore 16 and the production tubing 26 to supply pressurized control fluid to actuate downhole tools. Conventionally, the legacy hydraulic control line 34 might be used to hold a hydraulically-operated SSSV open, which may close in the event the control line is severed or rendered inoperable. Although the hydraulic control line 34 may be present in a well installation, and may be used for actuation of other tools, it is not required for control of the disclosed SSSV 50. Instead, the linear electromechanical actuator 100 maintains the SSSV 50 in an open condition during normal operation, with electromechanical fail-safe features in case electrical power to the linear electromechanical actuator 100 is removed.

FIGS. 2-12 provide non-limiting example configurations of linear electromechanical actuators comprised of different combinations of modules. Each module may have different mechanical and/or electrical features to perform a particular function or set of related functions. The modules may be described in shorthand fashion herein by their functional descriptor (without use of the word "module"). The modules are collectively used to construct different configurations of a linear electromechanical actuator. The modules may be modular at least in the sense that they may comprise independent units that can be combined to achieve different linear electromechanical actuator configurations. The modules may be preconfigured in the sense that their mechanical and/or electrical features may be specific to the respective module, but are designed in a way that they are compatible with other modules and can therefore be combined and work together in the various linear electromechanical actuator configurations. Thus, a different selection of modules may be selected to achieve a desired result or performance specification. This modularity may also allow for a module to be selectively removed, repaired, or replaced with an equivalent or different module. However, the disclosed aspects do not require a modular construction, and embodiments may include a system or device that perform the disclosed functions and combinations of functions without necessarily being structured as a combination of discrete modules. Thus, any given module in an example configuration may be substituted by a non-modular component performing that function to achieve an alternate configuration without departing from the scope of this disclosure.

Figure 2:
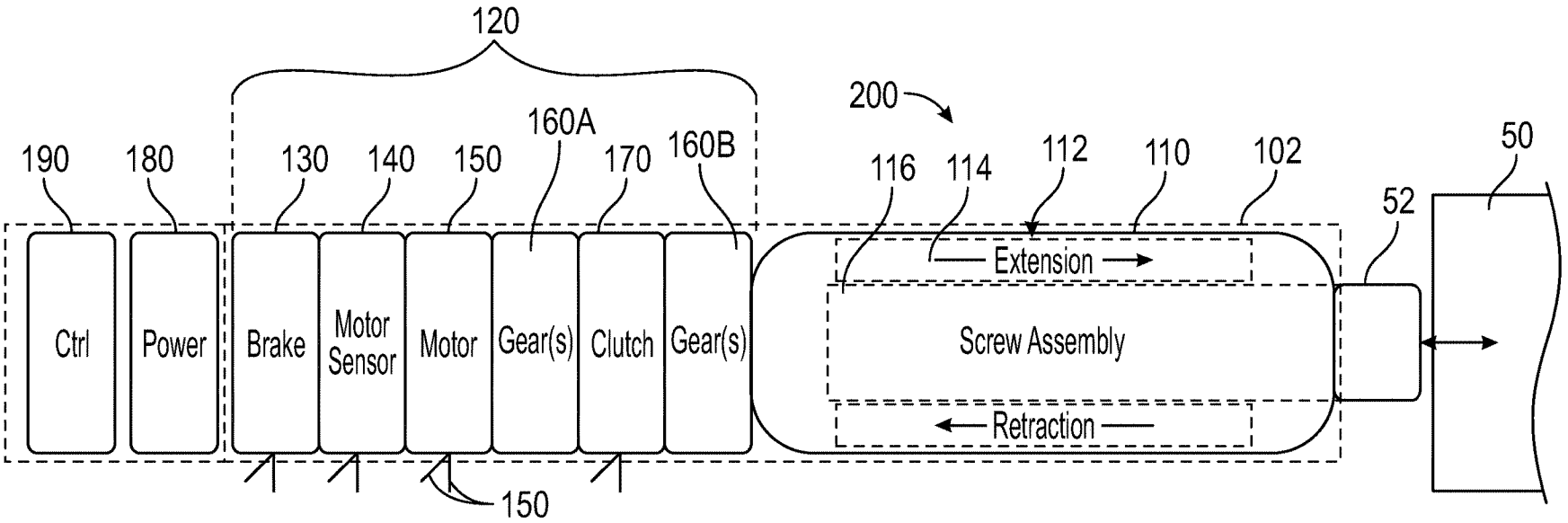
FIG. 2 is a schematic diagram of a linear electromechanical actuator according to an example configuration, which may be a more specific implementation of the linear electromechanical actuator schematically depicted in FIG. 1 for controlling the SSSV.

FIG. 2 is a schematic diagram of a linear electromechanical actuator 200 according to an example configuration, which may be a more specific implementation of the linear electromechanical actuator 100 schematically depicted in FIG. 1 for controlling the SSSV 50. The linear electromechanical actuator 200 includes a mechanical drive section 110 for physically actuating the SSSV 50 and an actuator control section 120 including various components, including electromechanical components, used to operate the SSSV 50 via the mechanical drive section 110. The components of the linear electromechanical actuator 200 may be grouped together in an actuator housing 102, which may be integral with a housing of the SSSV 50. The actuator housing 102 may comprise a single or multiple interconnected housing sections, and with suitable connectors for incorporating the linear electromechanical actuator 200 into a tool string or work string or the linear electromechanical actuator 200 may be an integral subassembly of the SSSV 50 or other device to be actuated. Generally, the linear electromechanical actuator 200 in any of the examples below may convert rotation of a motor to linear motion of an actuating member to urge the SSSV 50 to an open position against the biasing action of a spring or other biasing member. This can be accomplished by a variety of implementations, including but not limited to threaded members or a rack-and-pinion style mechanism. Example configurations of the SSSV 50 that are actuated by linear movement will be discussed further below in reference to FIGS. 13 and 14.

Referring still to FIG. 2, the present example of the mechanical drive section 110 includes a threaded mechanism 112 to convert rotational output of a member to linear translation of a member. The threaded mechanism 112 may be of any suitable type to selectively at least extend an actuating member 52 to urge the SSSV 50 open in opposition to a biasing member. The threaded mechanism 112 may be capable of retracting the actuating member 52 to close or allow to close the SSSV 50. The threaded mechanism 112 includes cooperating threaded members that are threadedly engaged to drive linear motion of one threaded member in response to relative rotation between the threaded members. In this example, a first threaded member is a cylindrical section 114 that has an internal thread that matches an external thread of the other threaded member, which comprises a threaded shaft 116. The actuating member 52 in this example may be the shaft 116 or a portion of the shaft 116, or another member engaged by the shaft 116. The threaded mechanism 112 may comprise, for example, a ball screw, a roller screw, a lead screw, or other suitable screw mechanism. The screw mechanism can include single lead screws or multiple lead screws. If a multiple lead screw, the force and operational requirements may determine the number of leads.

The actuator control section 120 is coupled to the mechanical drive section 110 and includes a plurality of functional modules for powering and controlling operation of the mechanical drive section 110. The modules in this example include a brake module 130, a motor sensor module 140, a motor module 150, two gearing modules 160A, 160B each comprising its own gear set, and a clutch module 170 that cooperate to control the drive mechanism 110. Optionally, power and/or control signals may be sent from surface via the completion system at the well site. Alternatively, the linear electromechanical actuator 200 may be a self-contained system, which may further include a downhole power module 180 (e.g., battery) and control module 190 with control logic for controlling operation of the linear electromechanical actuator 200. These various modules optionally include their own module housings, and may be grouped together in an actuator housing 102, together or separate from a housing of the drive mechanism 110. The modules may be in electrical communication with each other or at least specific other modules in the optionally modular actuator control section 120 and/or with a surface (above-ground) information handling system (not expressly shown).

The motor module 150 electrically powers movement of the drive mechanism 110, e.g., rotation of the screw assembly. The motor module 150 includes one or more sets of electrical wires 151 for providing electrical power from an electrical power source (e.g., a power module) and any control signals to the motor module 150, such as ON/OFF, RPM, and other motor parameters. Example motor options include stepper motors, brushed motors, or brushless direct current (BLDC) motors. A BLDC can also be known as a servo motor. The term BLDC may be used herein to describe any motor that is not a stepper motor or a brushed motor. These motors typically use a DC voltage, but an AC motor can be substituted for the DC motor.

A motor sensor module 140 is optionally included with the linear electromechanical actuator 100 for providing positional feedback (e.g., angular position information) regarding the motor or motor shaft thereof. These devices may comprise resolvers (aka field director) and Hall effects sensors, which may be known by other names. Typically, a BLDC motor works best with motor sensor, but can operated without one. A stepper motor typically does not require a separate motor sensor.

The motor sensor module 140 may provide a positional signal back to the motor module 150 itself or to the control module 190 or a surface controller, such as to ensure the motor module 150 is rotating in the intended direction, to determine or control an angular velocity or position of the motor module 150, or other parameters. The motor module 150 in any given configuration may be coupled, directly or indirectly, to the mechanical drive section 110 to urge the SSSV 50 to the open position. Other modules may be coupled between the motor module 150 and the mechanical drive section 110, such as the gearing modules 160 and clutch module 170 in FIG. 2.

In the example of FIG. 2, the gearing modules 160A, 160B are coupled between the motor module 150 and the mechanical drive section 110 using the respective gear sets to convert rotational motion from the motor module 150 as output to an input to the drive mechanism 110, such as to provide a desired speed, RPM, torque, or power, and/or mechanical advantage. The gearing can include a single-stage or multi-stage gearbox or a multistage gearbox. For most single-stage gearboxes, the directions of rotation of the input and output shafts are opposite, while for two-stage gearboxes, the additional change in direction by the second stage puts the output shaft rotation the same as the input shaft. In the case of a multistage gearbox, the stages can split, e.g., a gearbox with 3 total stages which has a 1-stage gearbox and a 2-stage gearbox or even three 1-stage gearboxes. The gearbox(es) can located anywhere in the linear electromechanical actuator 200 where they are needed. For example, a preferred actuator would have a 1-stage gearbox between the screw assembly (drive mechanism 110) and the clutch module 170 along with a multi-stage gearbox between the clutch module 170 and motor module 150.

The clutch module 170 is provided to couple and selectively decouple the motor module 150 of the actuator control section 120 from the drive section 110. The clutch is typically a normally open device, i.e., one that opens or disengages when power is removed. When power is removed from the clutch module 170, the clutch module 170 disengages, allowing the SSSV 50 to close. The clutch module 170 contributes to the failsafe design, whereby a loss of power to the motor module 150 or to the actuator control section 120 generally allows the SSSV 50 to close. The clutch can be any of a variety of clutch types, including but not limited to a friction device, a geared device (e.g., has a gear profile that engages and disengages), a solenoid type device that latches and unlatches. Although a normally-open configuration is generally preferred, if power is available when the SSSV needs to go closed, a normally closed device can instead be used.

The brake module 130 is optionally included to help the actuator control section 120 maintain the SSSV 50 in the open condition. The SSSV 50 includes a spring or other biasing member that biases the valve closure member to a closed position (like in the spring-biased flapper of FIG. 13, for example). This biasing member exerts a force against the actuator whenever the actuator is extended. The motor module 150 provide some resistance to motion. However, there is a risk when the linear electromechanical actuator 200 is extended and the motor module 150 is turned off that the spring will cause the SSSV to slowly close. This is typically called creep closure due to the slow nature of the closure. The motor module 150 could be actively powered to maintain the SSSV 50 in the open condition. However, doing so can consume excess electrical power and/or decrease the life of the motor module 150. Instead, the brake module 130 can be used to hold the actuating member 52 in the extended position in order to keep the SSSV 50 open and prevent creep closure. The brake module 130 is preferably a "normally open" configuration, meaning that the brake module 130 can be powered to hold the actuating member 52 open and released in the event of a power loss (so as to prevent interfering with closure of the SSSV 50). Alternatively, the brake module 130 could have a normally closed configuration, which may default to holding the SSSV 50 open, as a separate or redundant power supply to another power supply whose power loss would trigger a shut-in.

The power module 180 may comprise a battery or other electromotive source for powering the components of the actuator control section 120. The control module 190 may include one or more processors, memory, digital or analog inputs/outputs, etc., in communication with one or more of the modules in the actuator control section 120, such as along a bus. The control module may also include control logic executable by the processor for controlling operation of the actuator control section 120 or the various modules and other components thereof. In this example, the linear electromechanical actuator 200 is a self-contained unit with the on-board power module 180 and control module 190. However, other embodiments may include power and/or control signals from surface, either alone or in combination with an on-board power module and/or control module.

Figure 3:
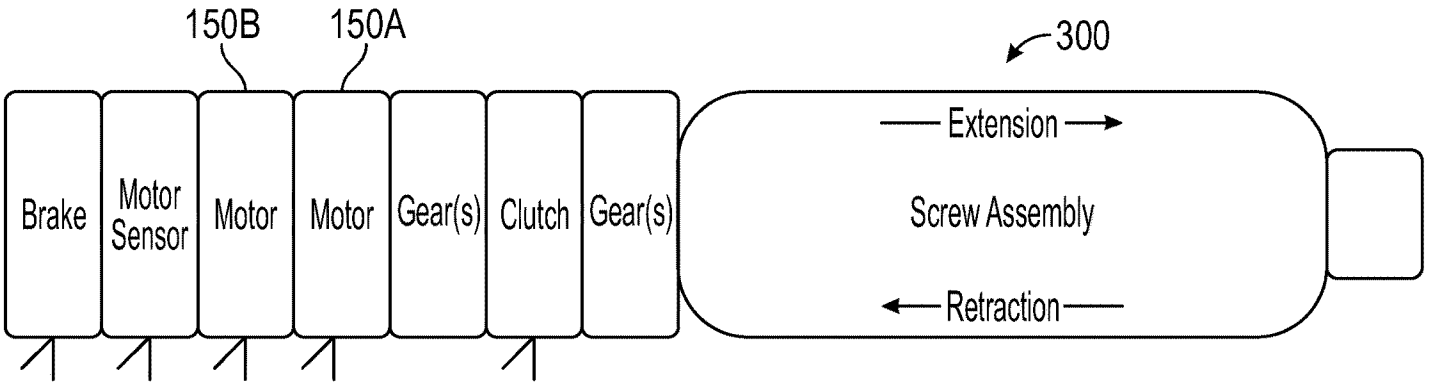
FIG. 3 is a schematic diagram of a linear electromechanical actuator according to an example configuration having the same modules as FIG. 2 but with dual motor modules.

FIG. 3 is a schematic diagram of a linear electromechanical actuator 300 according to an example configuration having the same modules as in FIG. 2 but with dual motors comprising an electrically-powered motor 150A and a redundant electrically-powered motor 150B configured for selectively actuating the SSSV. The dual-motor configuration may provide redundancy, so as to avoid having to trip in and replace a motor if one of the motors 150A, 150B were to fail. The dual motors may also provide additional power, such as in case of an anomaly (e.g., a stuck valve) wherein one of the motors is insufficient to open the SSSV.

Figure 4:
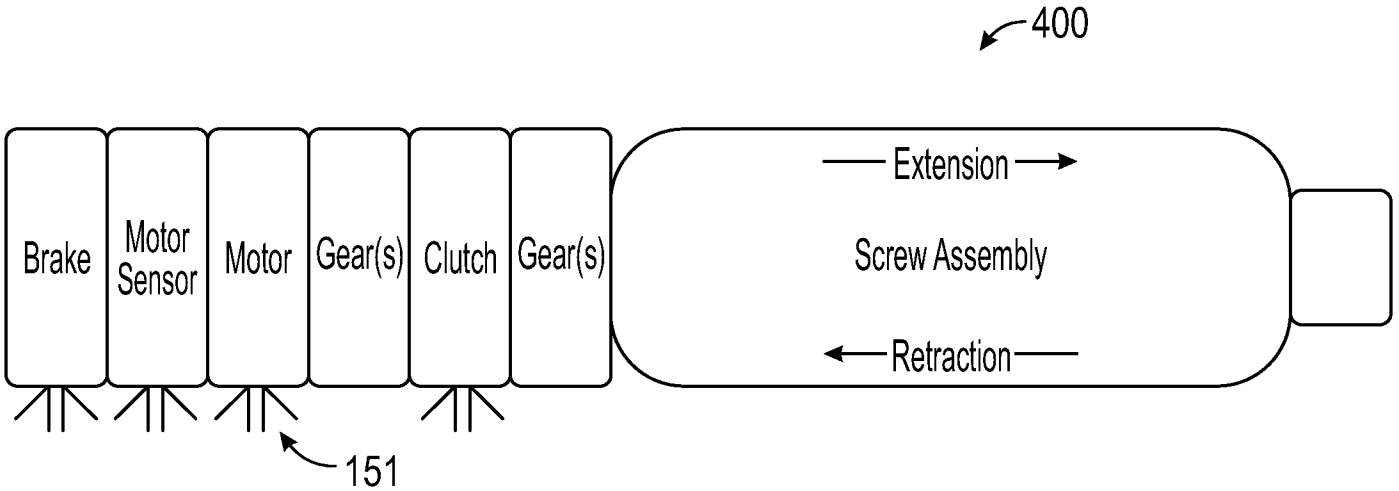
FIG. 4 is a schematic diagram of a linear electromechanical actuator according to an example configuration having the same modules as in FIG. 2 but with redundant electrical features.

FIG. 4 is a schematic diagram of a linear electromechanical actuator 400 according to an example configuration having the same modules as FIG. 2 but with redundant electrical features. This is schematically suggested, at least in part, by the illustration of additional sets of wires 151. (The representative wires are not intended to imply any specific number or arrangement of wires.) The various electrical modules (motor and motor sensor, clutch, brake, etc.) may each have at least one coil, one winding, one circuitry, or other electrical feature, as the case may be. To improve reliability, the devices can include two or more coils, multiple sets of circuitry, and/or multiple sets of windings, as the case may be. By having multiples instances of these electrical features, redundancy can be built into the specific device, thereby increasing reliability and/or service life of the linear electromechanical actuator.

Figure 5:
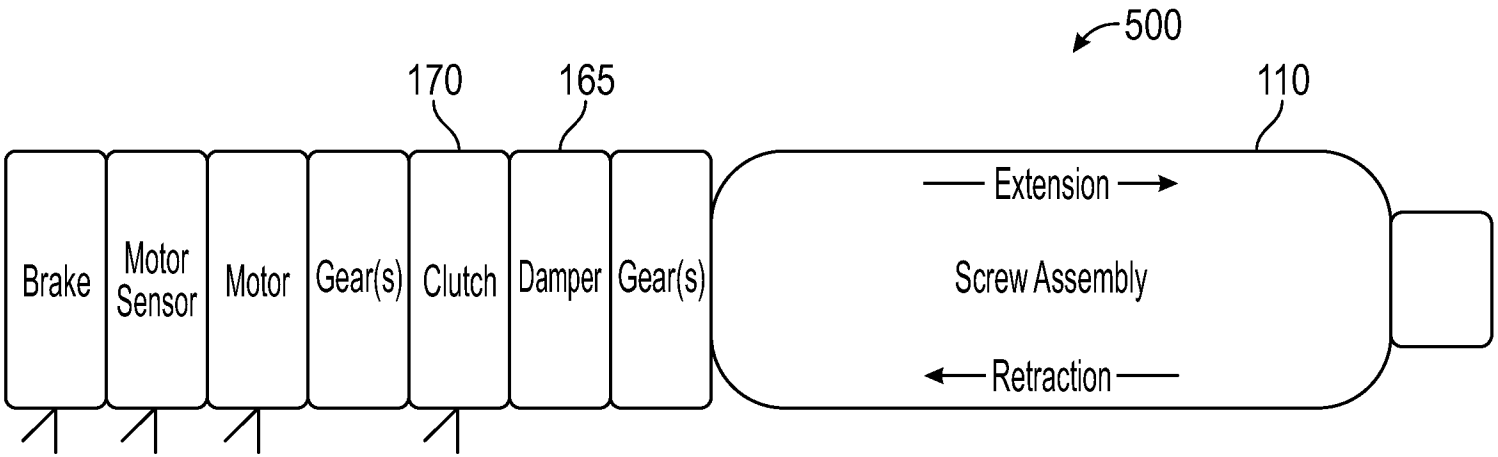
FIG. 5 is a schematic diagram of a linear electromechanical actuator according to an example configuration having the same modules as FIG. 2 plus a damper module.

FIG. 5 is a schematic diagram of a linear electromechanical actuator 500 according to an example configuration having the same modules as FIG. 2 plus a damper module 165. The damper module 165 can be used to dampen a closing speed, for example. The closing speed of the SSSV may need to be dampened to control a closing speed to below a threshold speed or to within a target speed range. For example, there may be an optimal speed or a target speed range for components of the mechanical drive section 110, such as the bearings and threads of a threaded drive mechanism. The damper 165 may comprise an eddy current damper, a motor assembly with shorted windings, etc. A preferred actuator does not require a damper 165, but if included a preferred location for the damper 65 would be between the screw assembly of the mechanical drive section 110 and the clutch module 170. The damper 165 could located at other locations in the actuator configuration.

Figure 6:
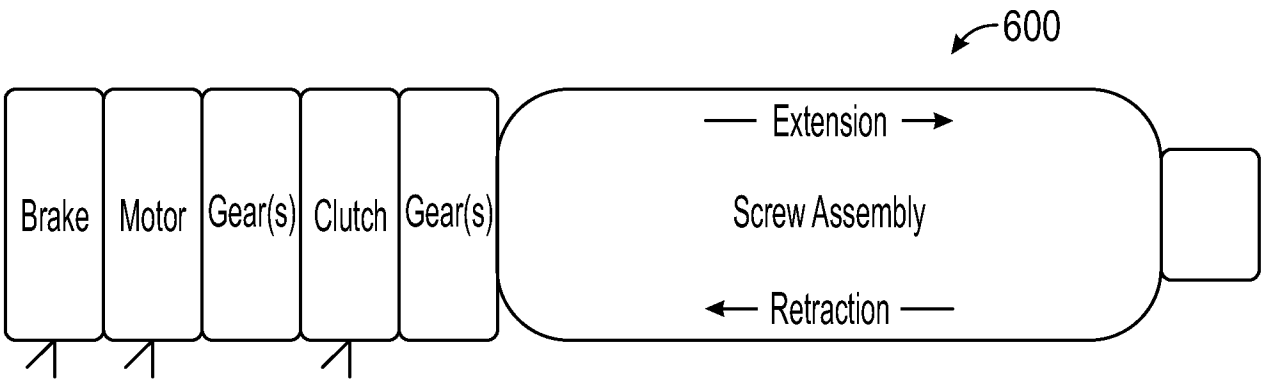
FIG. 6 is a schematic diagram of a linear electromechanical actuator according to an example configuration including all of the modules of FIG. 2 except for the motor sensor module.

FIG. 6 is a schematic diagram of a linear electromechanical actuator 600 according to an example configuration including all of the modules of FIG. 2, except omitting the motor sensor module. For example, even though a BLDC motor may utilize a motor sensor, one can optionally be operated even without a motor sensor. As another example, a stepper motor typically does not require a separate motor sensor.

Figure 7:
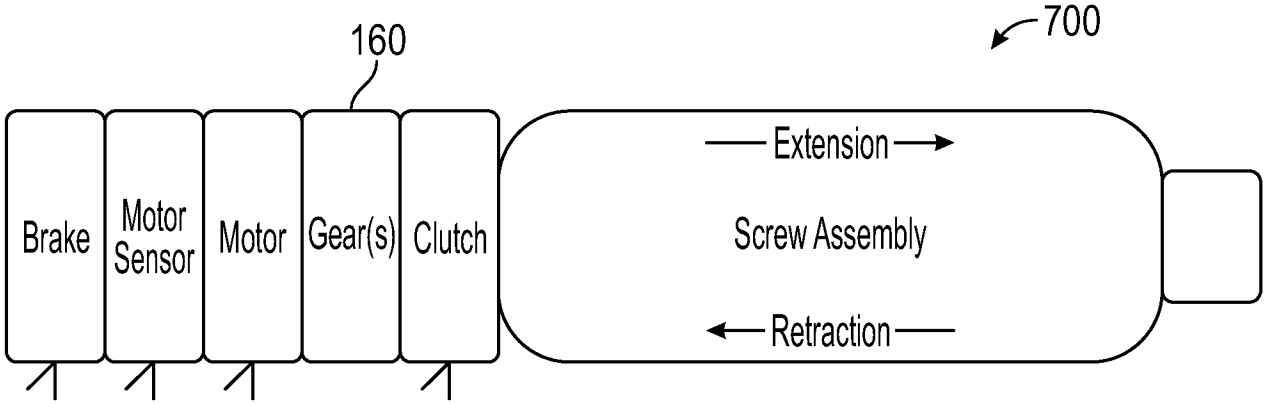
FIG. 7 is a schematic diagram of a linear electromechanical actuator according to an example configuration including the same modules as FIG. 2 except with one gearing module instead of two.

FIG. 7 is a schematic diagram of a linear electromechanical actuator 700 according to an example configuration including the same modules as FIG. 2 except with one gearing module 160 instead of two.

Figure 8:
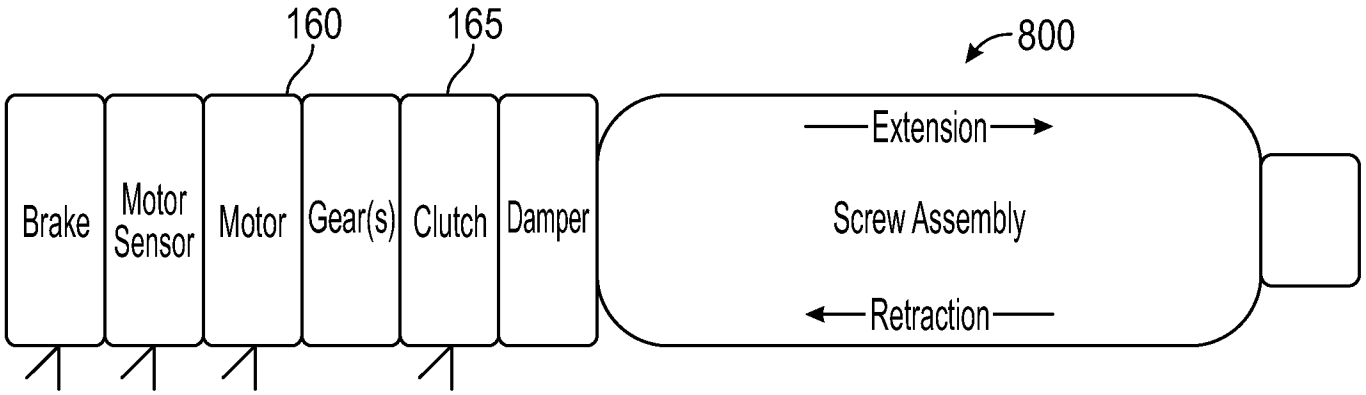
FIG. 8 is a schematic diagram of a linear electromechanical actuator according to an example configuration having only one gearing module but also a damper module between the clutch and screw assembly.

FIG. 8 is a schematic diagram of a linear electromechanical actuator 800 according to an example configuration having only one gearing module 160 but also a damper module 165 between the clutch and screw assembly.

Figure 9:
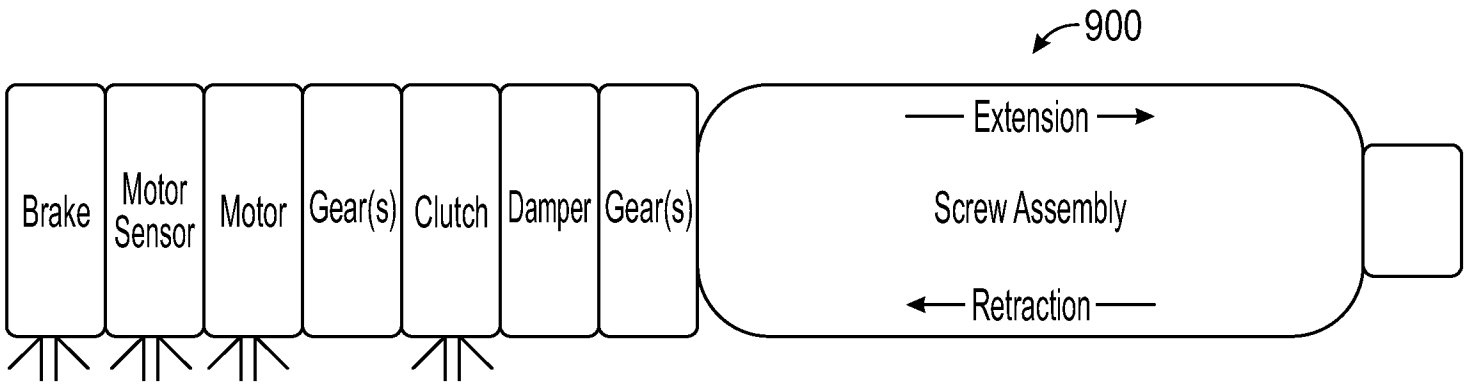
FIG. 9 is a schematic diagram of a linear electromechanical actuator according to an example configuration including the same modules as FIG. 5 but with redundant electrical features.

FIG. 9 is a schematic diagram of a linear electromechanical actuator 900 according to an example configuration including the same modules as FIG. 5 but with redundant electrical features.

Figure 10:
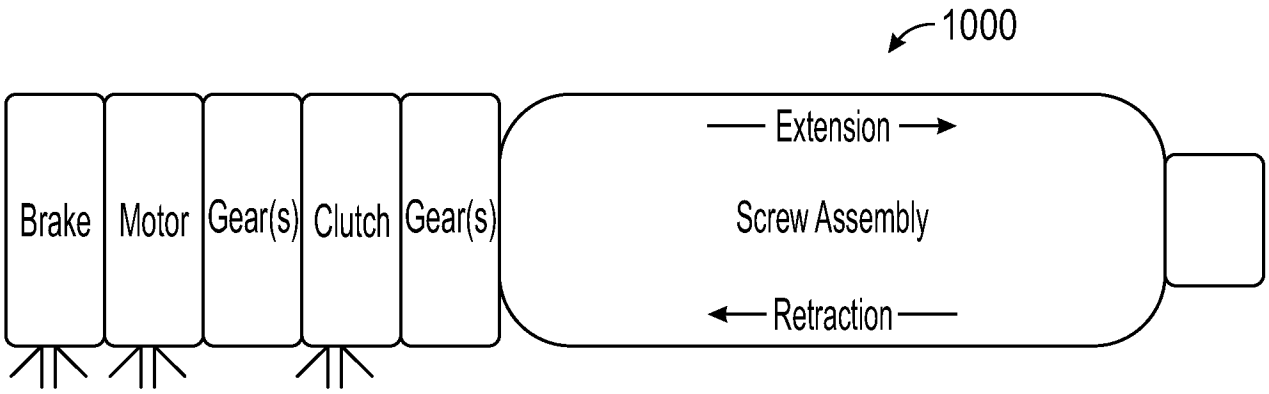
FIG. 10 is a schematic diagram of a linear electromechanical actuator according to an example configuration including the same modules as FIG. 6 but with redundant electrical features.

FIG. 10 is a schematic diagram of a linear electromechanical actuator 1000 according to an example configuration including the same modules as FIG. 6 but with redundant electrical features.

Figure 11:
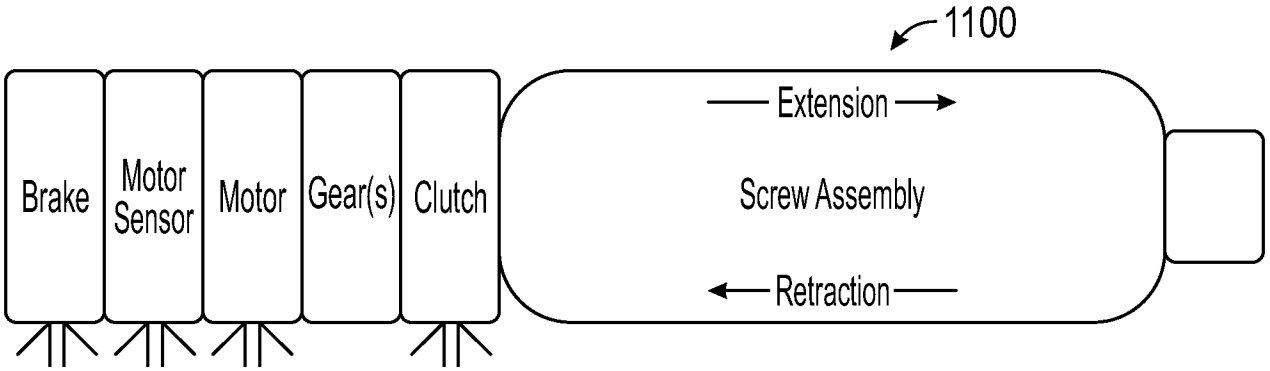
FIG. 11 is a schematic diagram of a linear electromechanical actuator according to an example configuration including the same modules as FIG. 7 but with redundant electrical features.

FIG. 11 is a schematic diagram of a linear electromechanical actuator 1100 according to an example configuration including the same modules as FIG. 7 but with redundant electrical features.

Figure 12:
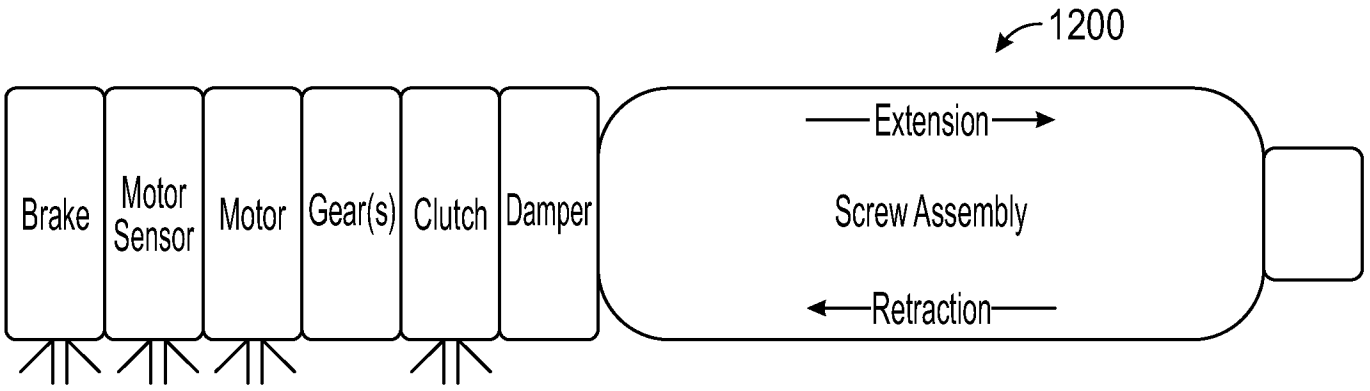
FIG. 12 is a schematic diagram of a linear electromechanical actuator according to an example configuration including the same modules as FIG. 8 but with redundant electrical features.

FIG. 12 is a schematic diagram of a linear electromechanical actuator 1200 according to an example configuration including the same modules as FIG. 8 but with redundant electrical features.

Figure 13:
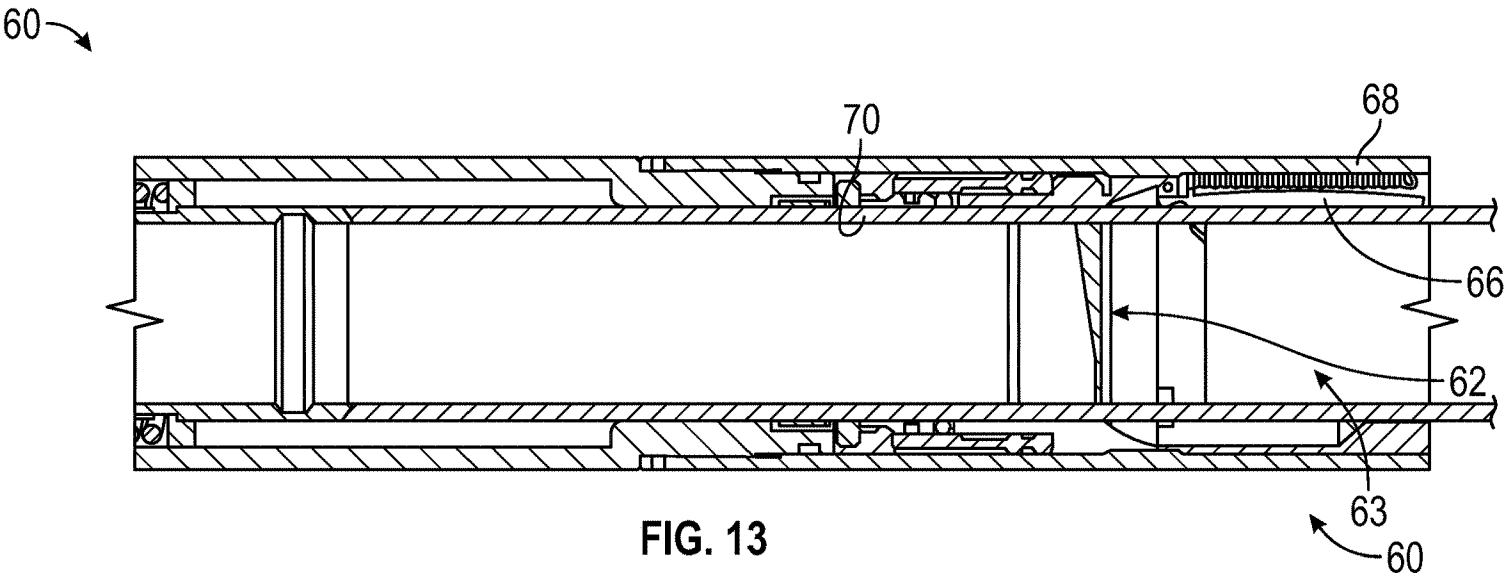
FIG. 13 is a detailed view of an example of a flapper valve as one non-limiting example of an SSSV that may be connected downhole of the linear electromechanical actuator of any of FIGS. 2-12.

FIG. 13 is a detailed view of an example of a flapper valve 60 as one non-limiting example of an SSSV that may be connected downhole of the linear electromechanical actuator of any of FIGS. 2-12. The flapper valve 60 includes a valve bore 62 in fluid communication with a mandrel bore 63, a valve seat 64, and a flapper 66. The flapper 66 is an example of a valve closure element that is pivotable between an open position as shown in FIG. 13, allowing flow through the valve bore 62, and a closed position against the valve seat 64, that closes flow through the valve bore 62. The flapper valve 60 in this example pivots in one direction to open and in the other direction to close. The flapper 66 is shown here in the open position but is biased toward the closed position by a biasing member embodied by way of example as a flapper close spring 68. The linear actuating member of the linear electromechanical actuator may axially urge the mandrel 70. With the flapper valve 60 connected below the linear electromechanical actuator, the mandrel 70 props the flapper 66 open against the biasing action of the flapper close spring 68. Propping the flapper 66 open while the work string is connected allows fluids such as stimulation treatments to be supplied downhole through the work string into the lower completion string, and formation fluids to be produced from the lower completion string and up through the work string to surface. When power is lost to the linear electromechanical actuator, the flapper 66 is pivotable and urged to a closed position by the flapper close spring 68 as the biasing member.

Figure 14:
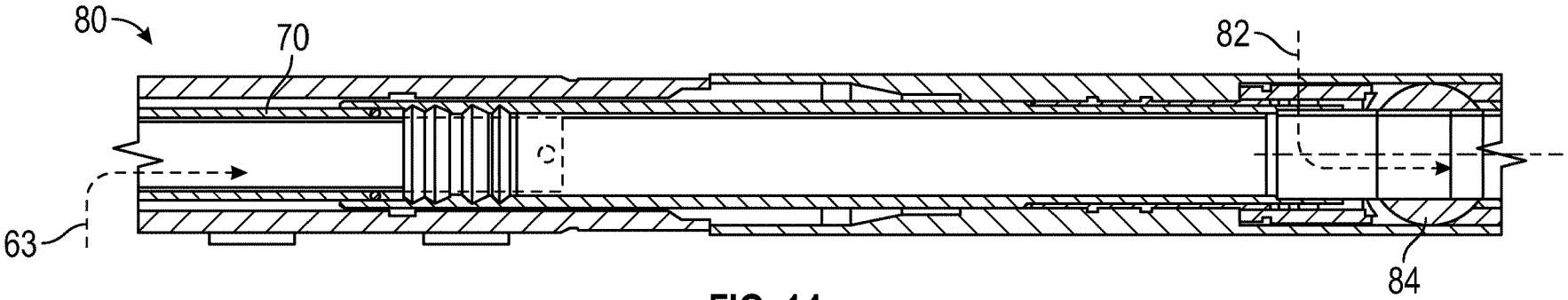
FIG. 14 is a detailed view of an example of a ball valve as another non-limiting example of an SSSV that may be connected downhole of the linear electromechanical actuator of any of FIGS. 2-12.

FIG. 14 is a detailed view of an example of a ball valve 80 as another non-limiting example of an SSSV that may be connected downhole of the linear electromechanical actuator of any of FIGS. 2-12. The ball valve 80 includes a valve bore 82 in fluid communication with the mandrel bore 63 when the ball valve 80 is open, i.e., with a ball 84 of the ball valve 80 in an open position. The valve bore 82 defines a bore axis. In the open position, the bore axis of the ball 84 is generally aligned with an axis of the mandrel 70. The linear actuating member of the linear electromechanical actuator may axially urge the mandrel 70. The ball 84 is an example of a valve closure element that is rotatable or pivotable between a fully open position as shown, or an intermediate open position wherein the ball 84 is partially rotated, in either case allowing at least some fluid flow through the valve bore 82, and a closed position that closes flow through the valve bore 82. Thus, the ball valve 80 is another example of an SSSV capable of being urged open and optionally closed or allowed to be closed by axial reciprocation of the mandrel 70 in response to linear motion of the actuating member of the linear electromechanical actuator.

Accordingly, the present disclosure may provide a linear electromechanical actuator for a downhole tool, and particularly for a downhole SSSV, as well as downhole flow control systems employing such a linear electromechanical actuator, and also related method. Embodiments may include any suitable combination of the features disclosed herein, including but not limited to the following examples.

Example 1. A linear electromechanical actuator for use in a well, comprising: an electrically-powered motor for driving a rotation; a drive section for converting the rotation of the motor to a linear movement of an actuating member for actuating a valve; and a clutch for coupling the motor with the drive section, wherein the clutch is configured to selectively decouple the motor from the drive section in response to a well shut-in event.

Example 2. The linear electromechanical actuator of Example 1, wherein the clutch has a normally open configuration in which the clutch couples the motor with the drive section when receiving electrical power and automatically de-couples the motor from the drive section when the clutch is not receiving the electrical power.

Example 3. The linear electromechanical actuator of any of Examples 1 or 2, wherein the drive section comprises a threaded mechanism for converting the rotation of the motor to the linear movement of the actuating member.

Example 4. The linear electromechanical actuator of any of Examples 1-3, further comprising: a brake configured to prevent a creep closure of the valve by resisting the rotation of one or more components of the actuator when the valve is in an open condition and the clutch is engaged.

Example 5. The linear electromechanical actuator of any of Examples 1-4, further comprising: a damper configured to dampen a closing speed of the valve.

Example 6. The linear electromechanical actuator of any of Examples 1-5, further comprising a redundant electrically-powered motor configured for selectively actuating the valve.

Example 7. The linear electromechanical actuator of any of Examples 1-7, further comprising one or more electrical features each comprising a corresponding redundant electrical feature operable to perform a function of the corresponding electrical feature in the event of a failure of that electrical feature.

Example 8. The linear electromechanical actuator of Example 7, wherein the electrical features and redundant electrical features comprise one or more elements of the group consisting of an electrical coil, a circuitry set, and an electrical winding.

Example 9. The linear electromechanical actuator of any of Examples 1-8, further comprising: one or both of a power module comprising a downhole battery electrically coupled to the power section and a control module comprising a downhole controller with control logic for controlling one or more functions of the linear electromechanical actuator.

Example 10. The linear electromechanical actuator of any of Examples 1-9, further comprising: one or more modules selected from the group consisting of a damper module, a gearing module, a motor module comprising the electrically-powered motor, a motor sensor module, a clutch module, and a brake module, the one or more modules comprising independent units that can be combined to achieve different linear electromechanical actuator configurations.

Example 11. A subsurface flow control system, comprising: a subsurface safety valve for controlling flow of production fluids, including a valve closure element moveable between an open position and a closed position in response to a linear movement of an actuating member and a biasing member for biasing the valve closure element to the closed position; a power section with an electrically-powered motor for driving a rotation; a drive section coupled to the power section for converting the rotation of the motor to the linear movement of the actuating member to at least open the subsurface safety valve; and a clutch for selectively decoupling the power section from the drive section, wherein the clutch is normally open and is configured to disengage in response to a power loss.

Example 12. The subsurface flow control system of Example 11, wherein the drive section comprises a threaded mechanism for converting the rotation of the motor to the linear movement of the actuating member.

Example 13. The subsurface flow control system of Example 11 or 12, further comprising: a brake configured to prevent a creep closure of the valve by resisting the rotation of the motor to resist the linear movement of the actuator when the valve is in an open condition and the clutch is engaged.

Example 14. The subsurface flow control system of any of Examples 11-13, further comprising: a damper configured to dampen a closing speed of the valve closure element.

Example 15. The subsurface flow control system of any of Examples 11-14, further comprising a redundant electrically-powered motor configured for selectively driving the rotation for conversion by the drive section to the linear movement of the actuating member.

Example 16. The subsurface flow control system of any of Examples 11-15, further comprising one or more electrical features each comprising a corresponding redundant electrical feature operable to perform a function of the corresponding electrical feature in the event of a failure of that electrical feature.

Example 17. The subsurface flow control system of Example 16, wherein the electrical features and redundant electrical features comprise one or more elements of the group consisting of an electrical coil, a circuitry set, and an electrical winding.

Example 18. The subsurface flow control system of any of Examples 11-17, further comprising: one or more modules selected from the group consisting of a damper module, a gearing module, a motor module comprising the electrically-powered motor, a motor sensor module, a clutch module, and a brake module, the one or more modules comprising independent units that can be combined to achieve different linear electromechanical actuator configurations of the subsurface flow control system.

Example 19. A method, comprising: controlling flow of production fluids from a well through a valve having a valve closure element moveable between an open position and a closed position; biasing the valve closure element to the closed position; generating rotation with an electrical motor; converting the rotation to a linear movement of an actuating member to urge the valve closure element to the open position against the biasing of the valve closure element; and selectively decoupling the electrical motor from the valve closure element in response to a power loss, thereby allowing the valve closure element to move to the closed position.

Example 20. The method of Example 19, further comprising: using a clutch to couple a motor with a drive section when receiving electrical power to urge the valve closure element to the closed position; and automatically de-coupling the motor from the drive section when the clutch is not receiving the electrical power to allow the valve closure element to move to the closed position.

Therefore, the present embodiments are well adapted to attain the ends and advantages mentioned as well as those that are inherent therein. The particular embodiments disclosed above are illustrative only. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A linear electromechanical actuator for use in a well, comprising:

an electrically powered motor for driving a rotation;

at least one resolver located next to the electrically powered motor to provide positional feedback to the electrically powered motor to ensure the electrically powered motor is rotating in the intended direction;

a drive section for converting the rotation of the motor to a linear movement of an actuating member for actuating a valve;

a clutch for coupling the motor with the drive section, wherein the clutch is configured to selectively decouple the motor from the drive section in response to a well shut-in event;

at least one single stage gearbox located between the drive section and the clutch;

at least one multi-stage gearbox located between the electrically powered motor and the clutch;

a brake located next to the at least one resolver and one or more redundant electrical features comprising two or more coils each operable to perform a function of the corresponding electrical feature in the event of a failure of that electrical feature.

2. The linear electromechanical actuator of claim 1, wherein the clutch has a normally open configuration in which the clutch couples the motor with the drive section when receiving electrical power and automatically de-couples the motor from the drive section when the clutch is not receiving the electrical power.

3. The linear electromechanical actuator of claim 1, wherein the drive section comprises a threaded mechanism for converting the rotation of the motor to the linear movement of the actuating member.

4. The linear electromechanical actuator of claim 1, wherein the brake is configured to prevent a creep closure of the valve by resisting the rotation of one or more components of the actuator when the valve is in an open condition and the clutch is engaged.

5. The linear electromechanical actuator of claim 1, further comprising:

a damper configured to dampen a closing speed of the valve, wherein the damper is located between the clutch and the at least one stage gearbox.

6. The linear electromechanical actuator of claim 1, further comprising a redundant electrically powered motor configured for selectively actuating the valve.

7. The linear electromechanical actuator of claim 1, further comprising:

one or both of a power module comprising a downhole battery electrically coupled to the power section and a control module comprising a downhole controller with control logic for controlling one or more functions of the linear electromechanical actuator.

8. The linear electromechanical actuator of claim 1, further comprising:

one or more modules selected from the group consisting of a damper module, a gearing module, a motor module comprising the electrically powered motor, a clutch module, and a brake module, the one or more modules comprising independent units that can be combined to achieve different linear electromechanical actuator configurations.

9. A subsurface flow control system, comprising:

a subsurface safety valve for controlling flow of production fluids, including a valve closure element moveable between an open position and a closed position in response to a linear movement of an actuating member and a biasing member for biasing the valve closure element to the closed position;

a power section with an electrically powered motor for driving a rotation;

at least one resolver located next to the electrically powered motor to provide positional feedback to the electrically-powered motor to ensure the electrically-powered motor is rotating in the intended direction;

a drive section coupled to the power section for converting the rotation of the motor to the linear movement of the actuating member to at least open the subsurface safety valve;

a clutch for selectively decoupling the power section from the drive section, wherein the clutch is normally open and is configured to disengage in response to a power loss;

at least one single stage gearbox located between the drive section and the clutch;

at least one multi-stage gearbox located between the electrically powered motor and the clutch;

a brake located next to the at least one resolver; and one or more redundant electrical features comprising two or more coils each operable to perform a function of the corresponding electrical feature in the event of a failure of that electrical feature.

10. The subsurface flow control system of claim 9, wherein the drive section comprises a threaded mechanism for converting the rotation of the motor to the linear movement of the actuating member.

11. The subsurface flow control system of claim 9, further comprising:

a brake configured to prevent a creep closure of the valve by resisting the rotation of the motor to resist the linear movement of the actuator when the valve is in an open condition and the clutch is engaged.

12. The subsurface flow control system of claim 9, further comprising:

a damper configured to dampen a closing speed of the valve closure element.

13. The subsurface flow control system of claim 9, further comprising a redundant electrically-powered motor configured for selectively driving the rotation for conversion by the drive section to the linear movement of the actuating member.

14. The subsurface flow control system of claim 9, further comprising:

one or more modules selected from the group consisting of a damper module, a gearing module, a motor module comprising the electrically-powered motor, a clutch module, and a brake module, the one or more modules comprising independent units that can be combined to achieve different linear electromechanical actuator configurations of the subsurface flow control system.

15. A method, comprising:

controlling flow of production fluids from a well through a valve having a valve closure element moveable between an open position and a closed position;

biasing the valve closure element to the closed position; generating rotation with an electrical motor;

providing positional signal back to the electrical motor using at least one resolver located next to the electrical motor;

ensuring the electrical motor is rotating in the intended direction;

converting the rotation to a linear movement of an actuating member to urge the valve closure element to the open position against the biasing of the valve closure element using a clutch for coupling the electrical motor with the valve closure element, at least one single stage gearbox located between the valve closure element and the clutch; at least one multi-stage gearbox located between the electrical motor and the clutch, and a brake located next to the at least one resolver;

selectively decoupling the electrical motor from the valve closure element in response to a power loss, thereby allowing the valve closure element to move to the closed position; and improving reliability and/or service life of the electrical motor with one or more redundant electrical features comprising two or more coils each operable to perform a function of the corresponding electrical feature in the event of a failure of that electrical feature.

16. The method of claim 15, further comprising:

using a clutch to couple a motor with a drive section when receiving electrical power to urge the valve closure element to the open position;

improving reliability and/or service life of the clutch with one or more redundant electrical features comprising two or more coils each operable to perform a function of the corresponding electrical feature in the event of a failure of that electrical feature; and automatically de-coupling the motor from the drive section when the clutch is not receiving the electrical power to allow the valve closure element to move to the closed position.

* * * * *